United States Patent [19]

Dantzig et al.

[11] Patent Number: 4,607,682

[45] Date of Patent: Aug. 26, 1986

[54] MOLD FOR USE IN METAL OR METAL ALLOY CASTING SYSTEMS

[75] Inventors: Jonathan A. Dantzig, Hamden; Derek E. Tyler, Cheshire, both of Conn.

[73] Assignee: Alumax, Inc., San Mateo, Calif.

[21] Appl. No.: 585,416

[22] Filed: Mar. 2, 1984

Related U.S. Application Data

[62] Division of Ser. No. 289,572, Aug. 3, 1981, Pat. No. 4,457,354.

[51] Int. Cl.[4] ..... B22D 11/00

[52] U.S. Cl. ..... 164/418; 164/137; 164/341

[58] Field of Search ..... 164/418, 443, 485, 6, 164/271, 339, 341, 137

[56] References Cited

U.S. PATENT DOCUMENTS

| | | | |
|---|---|---|---|
| 3,435,881 | 4/1969 | Smith et al. | 164/418 |
| 3,525,380 | 8/1970 | Moore | 164/418 |
| 3,612,158 | 10/1971 | Rossi | 164/443 |

FOREIGN PATENT DOCUMENTS

| | | | |
|---|---|---|---|
| 1910902 | 11/1970 | Fed. Rep. of Germany | 164/443 |
| 45-5243 | 2/1970 | Japan | 164/443 |

*Primary Examiner*—Nicholas P. Godici
*Assistant Examiner*—Richard K. Seidel
*Attorney, Agent, or Firm*—Malcolm B. Wittenberg

[57] ABSTRACT

A mold for use in an apparatus and process utilizing an electromagnetic field to stir a molten metal or metal alloy comprises a plurality of laminations of thermally and electrically conductive material separated by electrically insulating material. The electrically insulating material is oriented to minimize at least some of the flow path lengths of currents induced in the mold whereby magnetic induction losses caused by the mold are substantially reduced and the stirring efficiency is enhanced.

10 Claims, 12 Drawing Figures

MOLD FOR USE IN METAL OR METAL ALLOY CASTING SYSTEMS

This is a division, of application Ser. No. 289,572 filed Aug. 3, 1981, now U.S. Pat. No. 4,457,354.

The invention herein is directed to an apparatus for producing a semi-solid alloy slurry for later use in casting or forging applications.

Methods for producing semi-solid thixotropic alloy slurries known in the prior art include mechanical stirring and inductive electromagnetic stirring. The processes for producing such a slurry with a proper structure require a balance between the shear rate imposed by the stirring and the solidification rate of the material being cast.

The mechanical stirring approach is best exemplified by reference to U.S. Pat. Nos. 3,902,544, 3,954,455, 3,948,650, all to Flemings et al. and 3,936,298 to Mehrabian et al. The mechanical stirring approach is also described in articles appearing in *AFS International Cast Metals Journal,* September, 1976, pages 11–22, by Flemings et al. and *AFS Cast Metals Research Journal,* December, 1973, pages 167–171, by Fascetta et al. In German OLS No. 2,707,774 published Sept. 1, 1977 to Feurer et al., the mechanical stirring approach is shown in a somewhat different arrangement.

In the mechanical stirring process, the molten metal flows downwardly into an annular space in a cooling and mixing chamber. Here the metal is partially solidified while it is agitated by the rotation of a central mixing rotor to form the desired thixotropic metal slurry for casting. The mechanical stirring approaches suffer from several inherent problems. The annulus formed between the rotor and the mixing chamber walls provides a low volumetric flow rate of thixotropic slurry. There are material problems due to the erosion of the rotor. It is difficult to couple mechanical agitation to a continuous casting system.

In the continuous casting processes described in the art, the mixing chamber is arranged above a direct chill casting mold. The transfer of the metal from the mixing chamber to the mold can result in oxide entrainment. This is a particularly acute problem when dealing with reactive alloys such as aluminum which are susceptible to oxidation.

The slurry is thixotropic, thus requiring high shear rates to effect flow into the continuous casting mold. Using the mechanical approach, one is likely to get flow lines due to interrupted flow and/or discontinuous solidification. The mechanical approach is also limited to producing semi-solid slurries which contain from about 30 to 60% solids. Lower fractions of solids improve fluidity but enhance undesired coarsening and dendritic growth during completion of solidification. It is not possible to get significantly higher fractions of solids because the agitator is immersed in the slurry.

In order to overcome the aforenoted problems, inductive electromagnetic stirring has been proposed in U.S. Pat. No. 4,229,210 to Winter et al. In that patent, two electromagnetic stirring techniques are suggested to overcome the limitations of mechanical stirring. Winter et al. use either AC induction or pulsed DC magnetic fields to produce indirect stirring of the solidifying alloy melt. While the indirect nature of this electromagnetic stirring is an improvement over the mechanical process, there are still limitations imposed by the nature of the stirring technique.

With AC inductive stirring, the maximum electromagnetic forces and associated shear are limited to the penetration depth of the induced currents. Accordingly, the section size that can be effectively stirred is limited due to the decay of the induced forces from the periphery to the interior of the melt. This is particularly aggravated when a solidifying shell is present. The inductive electromagnetic stirring process also requires high power consumption and the resistance heating of the stirred metal is significant. The resistance heating in turn increases the required amount of heat extraction for solidification.

The pulsed DC magnetic field technique is also effective; however, it is not as effective as desired because the force field rapidly diverges as the distance from the DC electrode increases. Accordingly, a complex geometry is required to produce the required high shear rates and fluid flow patterns to insure production of slurry with a proper structure. Large magnetic fields are required for this process and, therefore, the equipment is costly and very bulky.

The abovenoted Flemings et al. patents make brief mention of the use of electromagnetic stirring as one of many alternative stirring techniques which could be used to produce thixotropic slurries. They fail, however, to suggest any indication of how to actually carry out such an electromagnetic stirring approach to produce such a slurry. The German patent publication to Feurer et al. suggests that it is also possible to arrange induction coils on the periphery of the mixing chamber to produce an electromagnetic field so as to agitate the melt with the aid of the field. However, Feurer et al. does not make it clear whether or not the electromagnetic agitation is intended to be in addition to the mechanical agitation or to be a substitute therefor. In any event, it is clear that Feurer et al. is suggesting merely an inductive type electromagnetic stirring approach.

There is a wide body of prior art dealing with electromagnetic stirring techniques applied during the casting of molten metals and alloys. U.S. Pat. Nos. 3,268,963 to Mann, 3,995,678 to Zavaras et al., 4,030,534 to Ito et al., 4,040,467 to Alherny et al., 4,042,007 to Zavaras et al., 4,042,008 to Alherny et al., and 4,150,712 to Dussart, as well as an article by Szekely et al. entitled "Electromagnetically Driven Flows in Metals Processing", September, 1976, *Journal of Metals,* are illustrative of the art with respect to casting metals using inductive electromagnetic stirring provided in surrounding induction coils.

In order to overcome the disadvantages of inductive electromagnetic stirring, it has been found that electromagnetic stirring can be made more effective, with a substantially increased productivity and with a less complex application to continuous type casting techniques, if a magnetic field which moves transversely of the mold or casting axis such as a rotating field is utilized.

The use of rotating magnetic fields for stirring molten metals during casting is known as exemplified in U.S. Pat. Nos. 2,963,758 to Pestel et al., and 2,861,302 to Mann et al., and in U.K. Pat. Nos. 1,525,036 and 1,525,545. Pestel et al. disclose both static casting and continuous casting wherein the molten metal is electromagnetically stirred by means of a rotating field. One or more multipoled motor stators are arranged about the mold or solidifying casting in order to stir the molten metal to provide a fine grained metal casting. In the continuous casting embodiment disclosed in the patent to Pestel et al., a 6 pole stator is arranged about the mold and two 2 pole stators are arranged sequentially thereafter about the solidifying casting.

The adverse effect of the mold upon the electromagnetic stirring process has been recognized in the prior art. Metal or metal alloy molds tend to attenuate the stirring power of the magnetic field by causing magnetic induction losses. The prior art suggests solutions such as controlling the thickness of the mold and/or operating at low frequencies to obtain a satisfactory stirring effect. The Dussart patent suggests improving stirring efficiency by using a mold comprising a cooling box having grooves formed in its front wall attached to a copper plate having a reduced thickness.

Several of the disadvantages associated with the prior art approaches for making thixotropic slurries utilizing either mechanical agitation or inductive electromagnetic stirring have been overcome in accordance with the invention disclosed in U.S. patent application Ser. No. 15,250, filed Feb. 26, 1979 to Winter et al. and assigned to the assignee of the instant application. In this application, a rotating magnetic field generated by a two pole multi-phase motor stator is used to achieve the required high shear rates for producing thixotropic semi-solid alloy slurries to be used in slurry casting.

In U.S. patent application Ser. No. 184,089, filed Sept. 4, 1980 to Winter et al., which is a continuation of U.S. patent application Ser. No. 15,059, filed Feb. 26, 1979, a duplex mold is disclosed for use in the above-noted Winter et al. process and apparatus for forming a thixotropic semi-solid alloy slurry. The duplex mold comprises an inner liner of thermally insulating material mounted in the upper portion of the mold.

A water side insulating band for controlling the initial solidification of an ingot shell, which may be used in conjunction with the above-noted Winter et al. process and apparatus, is disclosed in U.S. patent application Ser. No. 258,232, filed Apr. 27, 1981, to Winter et al, now U.S. Pat. No. 4,450,893.

In U.S. patent application Ser. No. 279,917, filed July 2, 1981, now U.S. Pat. No. 4,465,118, to Dantzig et al., a process and apparatus utilizing electromagnetic stirring and having improved efficiency for forming a semi-solid thixotropic alloy slurry is disclosed. In accordance with the invention contained therein, it was found that by operating within a defined range of line frequencies, a desired shear rate for attaining a desired cast structure at reduced levels of power consumption and current could be achieved.

The present invention comprises an improved mold for use with a process and apparatus for forming a semi-solid alloy slurry. The mold of the instant invention comprises means for minimizing the path lengths of at least some of the currents induced in the mold material by the magnetic field used to stir the molten material. In this way, magnetic induction losses caused by the mold are reduced and the efficiency of the electromagnetic stirring process is improved. The mold of the instant invention has utility in many types of metal or metal alloy casting systems.

In accordance with the instant invention, a metal or metal alloy mold is fabricated with means for minimizing the path length of at least some of the currents induced within the mold structure itself. The minimizing means comprises electrical insulating means oriented in a plane substantially transverse to the direction of the induced current. In this manner, magnetic induction losses caused by the induced currents are reduced, the magnetic field at the periphery of the molten metal is enhanced, and the stirring effect on the molten metal is increased.

In a first embodiment of the instant invention, a completely laminated mold is formed from a stack of metal or metal alloy laminations separated by electrically insulating material. In an alternative arrangement, the laminated mold has its core fitted with a sheet of thermally conductive material. In another alternative embodiment, the mold comprises a metal or metal alloy tube having a plurality of slits cut therein to act as the means for minimizing the induced current path lengths.

Accordingly, it is an object of this invention to provide a process and apparatus having improved efficiency for casting a semi-solid thixotropic alloy slurry.

It is a further object of this invention to provide a process and apparatus as above having enhanced stirring of the molten material.

It is a further object of this invention to provide a process and apparatus as above having an improved mold construction for reducing magnetic induction losses.

It is a further object of this invention to provide a process and apparatus as above having an improved mold construction for minimizing the path length of at least some of the eddy currents produced within the mold material itself.

These and other objects will become more apparent from the following description and drawings.

Embodiments of the casting process and apparatus according to this invention are shown in the drawings wherein like numerals depict like parts.

In the background of this application, there have been described a number of techniques which may be used to form semi-solid thixotropic metal slurries for use in slurry casting. Slurry casting as the term is used herein refers to the formation of a semi-solid thixotropic metal slurry, directly into a desired structure, such as a billet for later processing, or a die casting formed from the slurry.

This invention is principally intended to provide slurry cast material for immediate processing or for later use in various applications of such material such as casting and forging. The advantages of slurry casting have been amply described in the prior art. Those advantages include improved casting soundness as compared to conventional die casting. This results because the metal is partially solid as it enters a mold and, hence, less shrinkage porosity occurs. Machine component life is also improved due to reduced erosion of dies and molds and reduced thermal shock associated with slurry casting.

The metal composition of a thixotropic slurry comprises primary solid discrete particles and a surrounding matrix. The surrounding matrix is solid when the metal composition is fully solidified and is liquid when the metal composition is a partially solid and partially liquid slurry. The primary solid particles comprise degenerate dendrites or nodules which are generally spheroidal in shape. The primary solid particles are made up of a single phase or a plurality of phases having an average composition different from the average composition of the surrounding matrix in the fully solidified alloy. The matrix itself can comprise one or more phases upon further solidification.

Conventionally solidified alloys have branched dendrites which develop interconnected networks as the temperature is reduced and the weight fraction of solid increases. In contrast, thixotropic metal slurries consist of discrete primary degenerate dendrite particles separated from each other by a liquid metal matrix, potentially up to solid fractions of 80 weight percent. The primary solid particles are degenerate dendrites in that they are characterized by smoother surfaces and a less branched structure than normal dendrites, approaching a spheroidal configuration. The surrounding solid matrix is formed during solidification of the liquid matrix subsequent to the formation of the primary solids and contains one or more phases of the type which would be obtained during solidification of the liquid alloy in a more conventional process. The surrounding solid matrix comprises dendrites, single or multi-phased compounds, solid solution, or mixtures of dendrites, and/or compounds, and/or solid solutions.

Figures 1, 2:
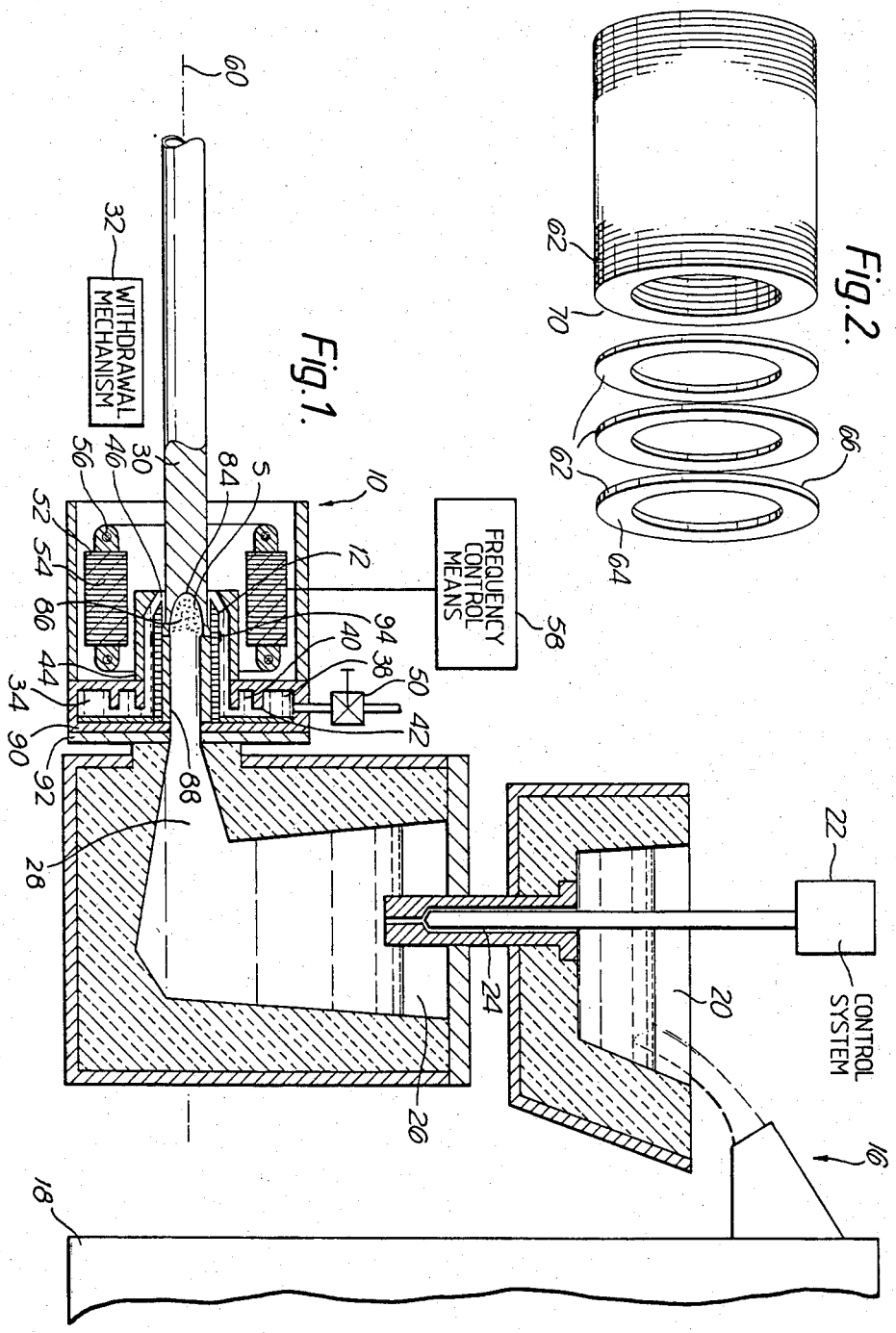
FIG. 1 is a schematic representation in partial cross section of an apparatus for casting a thixotropic semi-solid metal slurry in a horizontal direction.
FIG. 2 is a schematic view of a first embodiment of a mold to be used in the apparatus of FIG. 1.

Referring to FIG. 1, an apparatus 10 for continuously or semi-continuously slurry casting thixotropic metal slurries is shown. The cylindrical mold 12 is adapted for such continuous or semi-continuous slurry casting. The mold 12 may be formed in a manner to be later described of any desired non-magnetic material such as austenitic stainless steel, copper, copper alloy, aluminum, aluminum alloy, or the like.

Figure 7:
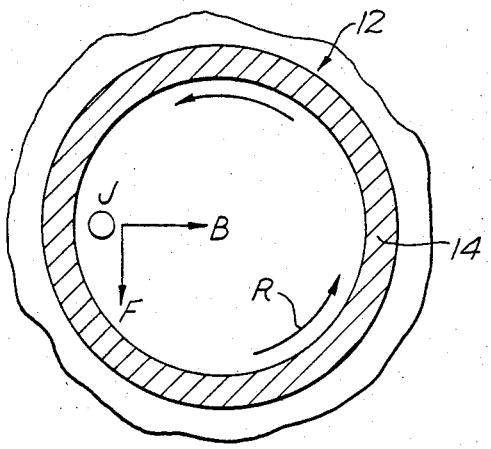
FIG. 7 is a schematic view of the instantaneous fields and forces which cause the molten metal to rotate.

Referring to FIG. 7, it can be seen that the mold wall 14 may be cylindrical in nature. The apparatus 10 and process of this invention are particularly adapted for making cylindrical ingots utilizing a conventional two pole polyphase induction motor stator for stirring. However, it is not limited to the formation of a cylindrical ingot cross section since it is possible to achieve a transversely or circumferentially moving magnetic field with a non-circular tubular mold arrangement not shown.

The molten material is supplied to mold 12 through supply system 16. The molten material supply system comprises the partially shown furnace 18, trough 20, molten material flow control system or valve 22, downspout 24 and tundish 26. Control system 22 controls the flow of molten material from trough 20 through downspout 24 into tundish 26. Control system 22 also controls the height of the molten material in tundish 26. Alternatively, molten material may be supplied directly from furnace 18 into tundish 26. The molten material exits from tundish 26 horizontally via conduit 28 which is in direct communication with the inlet to casting mold 12.

The solidifying casting or ingot 30 is withdrawn from mold 12 by a withdrawal mechanism 32. The withdrawal mechanism 32 provides the drive to the casting or ingot 30 for withdrawing it from the mold section. The flow rate of molten material into mold 12 is controlled by the extraction of casting or ingot 30. Any suitable conventional arrangement may be utilized for withdrawal mechanism 32.

A cooling manifold 34 is arranged circumferentially around the mold wall 14. The particular manifold shown includes a first input chamber 38, a second chamber 40 connected to the first input chamber by a narrow slot 42. A coolant jacket sleeve 44 formed from a non-conducting material is attached to the manifold 34. A discharge slot 46 is defined by the gap between the coolant jacket sleeve 44 and the outer surface 48 of mold 12. A uniform curtain of coolant, preferably water, is provided about the outer surface 48 of the mold 12. The coolant serves to carry heat away from the molten metal via the inner wall 36 of mold 12. The coolant exits through slot 46 discharging directly against the solidifying ingot 30. A suitable valving arrangement 50 is provided to control the flow rate of the water or other coolant discharged in order to control the rate at which the slurry S solidifies. In the apparatus 10, a manually operated valve 50 is shown; however, if desired this could be an electrically operated valve or any other suitable valve arrangement.

The molten metal which is poured into the mold 12 is cooled under controlled conditions by means of the water flowing over the outer surface 48 of the mold 12 from the encompassing manifold 34. By controlling the rate of water flow along the mold surface 48, the rate of heat extraction from the molten metal within the mold 12 is in part controlled.

In order to provide a means for stirring the molten metal within the mold 12 to form the desired thixotropic slurry, a two pole multi-phase induction motor stator 52 is arranged surrounding the mold 12. The stator 52 is comprised of iron laminations 54 about which the desired windings 56 are arranged in a conventional manner to preferably provide a three-phase induction motor stator. The motor stator 42 is mounted within a motor housing M. Although any suitable means for providing power and current at different frequencies and magnitudes may be used, power and current are preferably supplied to stator 52 by a variable frequency generator 58. The manifold 34 and the motor stator 52 are arranged concentrically about the axis 60 of the mold 12 and the casting 30 formed within it.

It is preferred to utilize a two pole three-phase induction motor stator 52. One advantage of the two pole motor stator 52 is that there is a non-zero field across the entire cross section of the mold 12. It is, therefore, possible with this invention to solidify a casting having the desired slurry cast structure over its full cross section.

Referring again to FIG. 7, the shearing effect created by the rotary magnetic field stirring approach is illustrated. In accordance with the Flemings righthand rule, for a given current density J in a direction normal to the plane of the drawing and magnetic flux vector B extending radially inwardly of the mold 12, the magnetic stirring force vector F extends generally tangentially of the mold wall 14. This sets up within the mold cavity a rotation of the molten metal in the direction of arrow R which generates a desired shear for producing the thixotropic slurry S. The force vector F is also normal to the heat extraction direction and is, therefore, normal to the direction of dendrite growth. By obtaining a desired average shear rate over the solidification range, i.e. from the center of the slurry to the inside of the mold wall, improved shearing of the dendrites as they grow may be obtained.

The stirring of the molten metal and the shear rates are functions of the magnetic induction at the periphery of the molten material. The mold is preferably made from a material having a high thermal conductivity in order to have the heat transfer characteristics required to effect solidification. Prior art molds are typically made of a thermally conductive material which tends to absorb significant portions of the induced magnetic field. It is known that this mold absorption effect increases as the frequency of the inducing current increases. As a result, prior art casting systems have been limited in the frequencies which they may utilize to operate efficiently.

The mold of the instant invention reduces magnetic induction losses by reducing the effect of the currents induced in the mold structure itself. This is done by minimizing the path length of the induced or eddy currents in at least part, if not substantially all, of the mold thickness. By effectively eliminating the eddy current paths, the magnetic induction is allowed to pass through the mold substantially unimpeded. The stirring effect on the molten material is thereby enhanced and the process has improved efficiency while operating over a wide range of inducing current frequencies. Furthermore, the required mold heat transfer characteristics are not substantially affected.

Referring now to FIG. 2, a first embodiment of the mold of the instant invention is shown. A completely laminated mold comprises a stack of metal or metal alloy laminations 62. The laminations 62 may have any desired shape. In the embodiment of FIG. 2, laminations 62 are preferably ring-shaped. The laminations 62 are preferably separated from each other by electrically insulating material. The electrically insulating material may comprise a coating of any of a variety of conventional varnishes on the upper 64 and/or lower 66 surfaces of each lamination. In lieu of varnish, an oxide layer not shown may be utilized on the surfaces of each lamination. The oxide layer may comprise a refractory oxide coating, such as an aluminum oxide coating, or any other suitable oxide coating. The oxide layer may be applied to the laminations in any suitable manner, such as spraying a coating on the surfaces. Alternatively, the laminations can be separated by insulating sheets or layers not shown. One or more insulating sheets may be disposed between adjacent laminations. The insulating sheets may be made of any suitable material, i.e. asbestos, mica, flurocarbons, phenolics, plastics such as polyvinylchloride, polycarbonates, etc.

The stator 52 produces a magnetic field which rotates about the casting axis 60. It is known that an induced current flows in a direction opposite that of the inducing current. When the inducing current flows in a direction A, the induced current in the mold will flow in the opposite direction B. The electrical insulating material is oriented so as to intercept the path of the induced current. In the embodiment of FIG. 2, the electrical insulating material preferably lies in a plane substantially transverse to the induced current direction. In this manner, the electrical insulating material acts as a barrier to the flow of the induced currents, thereby minimizing the path lengths of the induced currents and effectively or substantially eliminating magnetic induction losses in the mold. In the completely laminated mold of FIG. 2, substantially all of the induced currents have their path lengths minimized.

Each of the laminations 62 has a thickness $\Lambda$ related to the penetration depth $\delta$. The penetration depth is the distance from the outer mold wall at which the induced field decays to 1/e. The thickness $\Lambda$ should be less than about the penetration depth for any frequency which may be used. Preferably, the thickness $\Lambda$ is less than about one-third of the penetration depth for any such frequency. Penetration depth $\delta$ is defined by the equation:

$$\delta = \frac{1}{\sqrt{\omega\sigma\mu_o}} \quad (1)$$

where $\omega$=angular frequency $\sigma$=electrical conductivity of mold material $\mu_o$=magnetic permeability of mold material.

The choice of a lamination thickness is influenced by the electrical characteristics needed to be exhibited by the mold. For most frequencies used, $\Lambda$ may have a value of up to about 1 inch; however, $\Lambda$ is preferably in the range of about 1/32" to about $\frac{3}{8}$".

The mold should also exhibit heat transfer characteristics which are sufficient to effect solidification of the melt. These heat transfer characteristics influence the determination of a thickness for the electrical insulating material layers or coatings. The heat transfer capability of a mold is characterized by the thermal conductance of the mold. Since electrically insulating material is generally a non-conductor of heat, a mold having electrically insulating material incorporated therein generally has less thermal conductance than a mold not having electrically insulating material. As the amount of non-conducting material in the mold increases, the thermal conductance of the mold tends to decrease. In order to obtain the desired mold heat transfer characteristics, the layers or coatings of electrically insulating material could have a thickness which is about the same as the lamination thickness. Preferably, the thickness of these layers or coatings is between about one mil and about $\frac{3}{8}$".

A tubular mold is formed by placing the laminations 62 one on top of another and joining them together. The laminations 62 may be welded together by placing a fine bead in several locations. However, any suitable joining means, such as a bolt and nut assembly with insulating washers, may be used to join the laminations together. The mold may have any desired length. The overall wall thickness of the mold is a function of the desired electrical and heat transfer characteristics of the mold. The overall mold wall thickness may be up to about one inch but is preferably in the range of about $\frac{1}{8}''$ to about $\frac{3}{4}''$.

Figure 3:
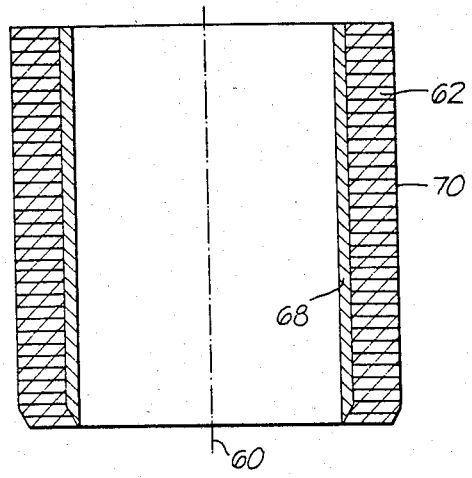
FIG. 3 is a schematic view in cross section of an alternative embodiment of the mold of FIG. 1.

An alternative embodiment of the mold 12 is shown in FIG. 3. This embodiment comprises a laminated mold which is substantially the same as that of FIG. 2 with the exception of core sleeve 68. The stack 70 of laminations having electrical insulating material therebetween is constructed in the same manner as the embodiment of FIG. 2. The laminations may be joined together in any suitable fashion and have any suitable thickness. The electrical insulating material also has any suitable thickness. The thickness of the laminations and the electrical insulating material, being influenced by the electrical and heat transfer characteristics needed by the mold as discussed hereinbefore, are preferably in the ranges discussed in conjunction with the embodiment of FIG. 2.

Core sleeve 68 preferably comprises a thin sheet or shell of thermally conductive material. The sheet or shell may be affixed to the lamination stack by any suitable mechanism such as thermal shrink-fitting, thermally conductive adhesive material, etc. Alternatively, core sleeve 68 may comprise a material, such as copper, chromium, etc., plated over the inner surface of stack 70. Core sleeve 68 is intended to provide a clean contiguous surface which does not interfere with castability in the mold. Core sleeve 68 may have any desired thickness; however, it should be less than about two-thirds of the penetration depth $\delta$ and preferably less than about one-third of the penetration depth $\delta$ for any frequency used. Penetration depth being defined by equation (1). By having a thickness in this range, there is no substantial absorption of the magnetic field by core sleeve 68 and the magnetic field passes through the mold substantially unimpeded. The core sleeve thickness may be up to about $\frac{3}{4}''$ and is preferably in the range of about one mil to about $\frac{1}{4}''$.

In the mold of FIG. 3, the electrical insulating material only intercepts and minimizes the flow path of some of the induced currents. Any current induced in core sleeve 68 flows substantially the entire mold length; however, the effect of such induced current on the magnetic field is reduced. While it is not fully understood why the effect on the magnetic field is reduced, it is believed that the thinness of core sleeve 68 causes it to have a higher resistance as compared to a mold having a larger cross section which in turn reduces the current flow.

The mold of FIG. 3 may have any desired length. With a mold type such as that of FIG. 3, the overall magnetic induction absorption mold effect is reduced as compared to that associated with standard types of molds. Therefore, the electromagnetic stirring of the molten metal should be enhanced over conventional electromagnetic stirring processes.

Figure 4:
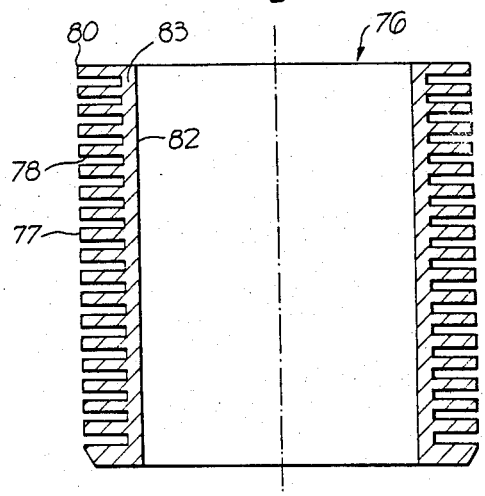
FIG. 4 is a schematic view in cross section of another alternative embodiment of the mold of FIG. 1.

In FIG. 4, another alternative embodiment of a laminated mold 12 is shown. The mold in this embodiment is constructed from a solid tube 76 of material such as aluminum, aluminum alloy, copper, copper alloy, austenitic stainless steel, etc., having any desired length. The tube has an array of slits 78 extending from the outer wall 80 to within a small distance of the inner wall 82. In this mold embodiment, slits 78 act as an air gap type of electrical insulator in minimizing the induced current path lengths. If desired, slits 78 may be filled with any suitable nonconducting material such as epoxy. The slits 78 have a thickness which is influenced by the heat transfer characteristics that the mold should exhibit. The slits 78 could have a thickness which is about the same as the lamination thickness. Preferably, the thickness of the slits is between about one mil and about $\frac{3}{8}''$.

In the embodiment of FIG. 4, the portions 77 of mold material between the slits form the laminations. The portions 77 add mechanical integrity to the mold. These portions 77 have a thickness $\Lambda$ which is less than about the penetration depth $\delta$ for any frequency used. Penetration depth $\delta$ again being defined by equation (1). Preferably, portions 77 have a thickness $\Lambda$ less than about one-third of the penetration depth for any frequency used. Thickness $\Lambda$ could be up to about 1 inch but is preferably in the range of about 1/32" to about $\frac{3}{8}''$.

As mentioned hereinbefore, slits 78 extend from outer wall 80 to a point substantially near inner wall 82. This point is less than about two-thirds of the penetration depth from inner wall 82 and is preferably less than about one-third of the penetration depth from inner wall 82 for any frequency used. In this manner, tube 76 has a solid continuous inner portion 83 which has a thickness less than about two-thirds of the penetration depth and preferably less than about one-third of the penetration depth for any frequency used. This thickness may be up to about $\frac{3}{4}''$ but is preferably in the range of about one mil to about $\frac{1}{4}''$.

Similar to the embodiment of FIG. 3, currents induced in portions 77 will have their flow paths intercepted and minimized by slits 78. Any current induced in portion 83 will flow substantially the entire mold length; however, the effect of the current induced in portion 83 on the magnetic field is reduced. While it is not fully understood, it is believed that the thinness of the inner portion 83 creates a higher resistance as compared to a mold having a larger cross section thickness. This in turn reduces the current flow and the current effect on the magnetic field. Hereto, the overall magnetic induction absorption effect is reduced as compared to that associated with standard types of mold. Therefore, the electromagnetic stirring of the molten metal should be enhanced over conventional electromagnetic stirring processes.

Figure 5:
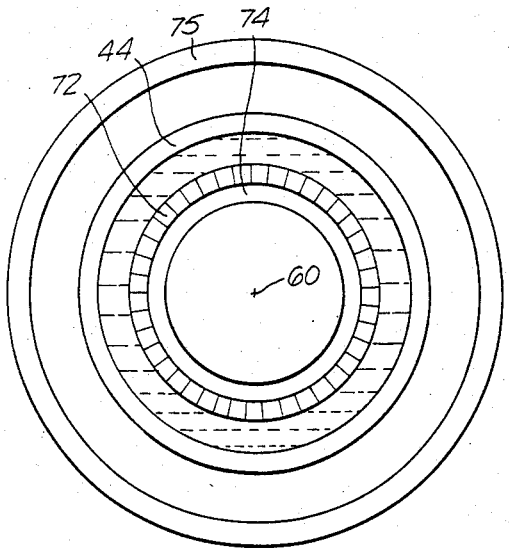
FIG. 5 is a top view of a mold which may be used in a casting apparatus utilizing a magnetic field parallel to the casting axis.

The embodiment of FIG. 5 is directed to a mold which may be used in an apparatus where the magnetic field is parallel to the casting axis 60. In order to produce such a magnetic field, the stirring coil 75 generally has an inducing current which moves circumferentially. The mold comprises a stack of substantially vertical laminations 72 separated by a barrier of electrically insulating material such as that in the mold embodiments of FIGS. 2–4. The electrically insulating material is oriented substantially transverse to the flow path of the inducing current. In this fashion, the path length of at least some induced currents will be minimized and the magnetic induction absorption substantially eliminated. If desired, the inner wall may have a core sleeve 74. Core sleeve 74 may comprise a thin sheet or shell or a thin plating of conductive material. The thicknesses of the laminations, the insulating material and the core sleeve are determined as described hereinbefore.

It is preferred that the stirring force field generated by the stator 52 extend over the full solidification zone of molten metal and thixotropic metal slurry S. Otherwise, the structure of the casting will comprise regions within the field of the stator 52 having a slurry cast structure and regions outside the stator field tending to have a non-slurry cast structure. In the embodiment of FIG. 1, the solidification zone preferably comprises a sump of molten metal and slurry S within the mold 12 which extends from the mold inlet to the solidification front 84 which divides the solidified casting 30 from the slurry S. The solidification zone extends at least from the region of the initial onset of solidification and slurry formation in the mold cavity 86 to the solidification front 84.

Figure 6:
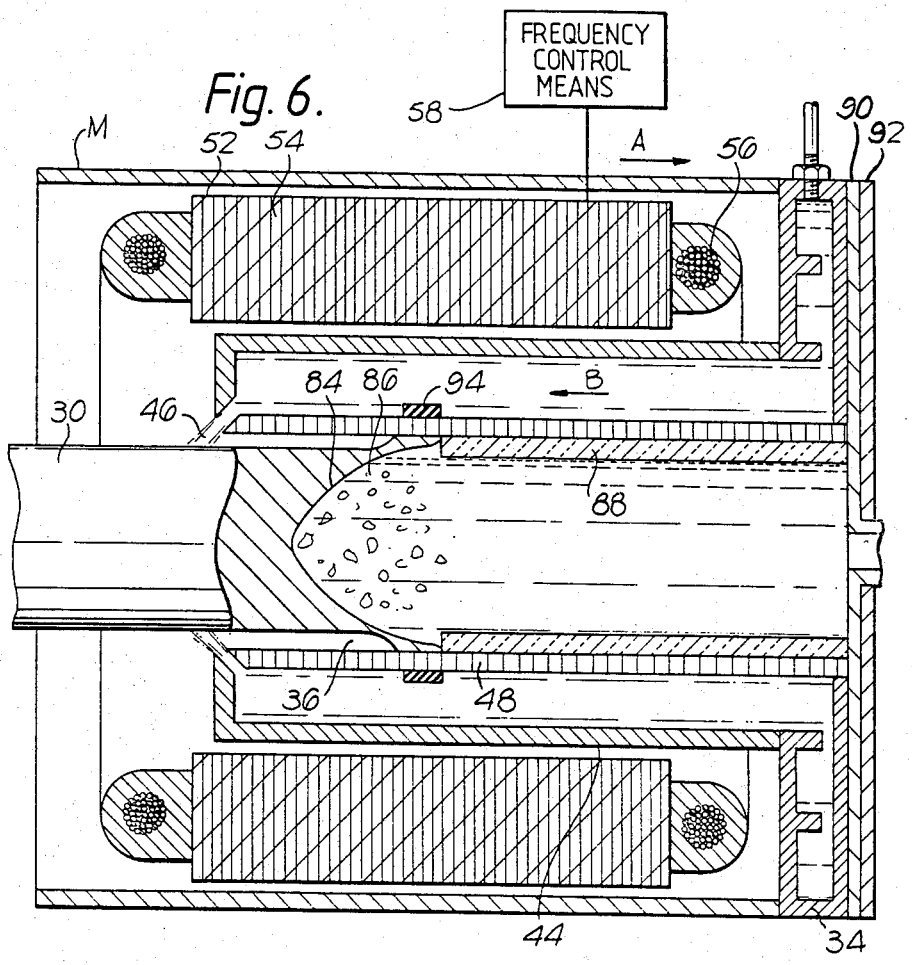
FIG. 6 is an enlarged view in cross section of the mold of FIG. 1 showing a thermal insulating liner and an insulating band used to postpone solidification of the casting.

Under normal solidification conditions, the periphery of the ingot 30 will exhibit a columnar dendritic grain structure. Such a structure is undesirable and detracts from the overall advantages of the slurry cast structure which occupies most of the ingot cross section. In order to eliminate or substantially reduce the thickness of this outer dendritic layer, the thermal conductivity of the inlet region of any of the molds may be reduced by means of a partial mold liner 88 as shown in FIG. 6 formed from an insulator such as a ceramic. The ceramic mold liner 88 extends from the insulating liner 90 of the mold cover 92 down into the mold cavity 86 for a distance sufficient so that the magnetic stirring force field of the two pole motor stator 52 is intercepted at least in part by the partial ceramic mold liner 88. The ceramic mold liner 88 is a shell which conforms to the internal shape of the mold 12 and is held to the mold wall 14. The mold 12 comprises a structure having a low heat conductivity inlet portion defined by the ceramic liner 88 and a high heat conductivity portion defined by the exposed portion of the mold wall 14.

The liner 88 postpones solidification until the molten metal is in the region of the strong magnetic stirring force. The low heat extraction rate associated with the liner 88 generally prevents solidification in that portion of the mold 12. Generally, solidification does not occur except towards the downstream end of the liner 88 or just thereafter. This region 88 or zone of low thermal conductivity thereby helps the resultant slurry cast ingot 30 to have a degenerate dendritic structure throughout its cross section even up to its outer surface.

If desired, the initial solidification of the ingot shell may be further controlled by moderating the thermal characteristics of the casting mold as discussed in copending application Ser. No. 258,232 to Winter et al, now U.S. Pat. No. 4,450,893. In a preferred manner, this is achieved by selectively applying a layer or band of thermally insulating material 94 on the outer wall or coolant side 48 of the mold 12 as shown in FIG. 6. The thermal insulating layer or band 94 retards the heat transfer through mold 12 and thereby tends to slow down the solidification rate and reduce the inward growth of solidification.

Below the region of reduced thermal conductivity, the water cooled metal casting mold wall 14 is present. The high heat transfer rates associated with this portion of the mold 12 promote ingot shell formation. However, because of the zone of low heat extraction rate, even the peripheral shell of the casting 30 could consist of degenerate dendrites in a surrounding matrix.

It is preferred in order to form the desired slurry cast structure at the surface of the casting to effectively shear any initial solidified growth from the mold liner 88. This can be accomplished by insuring that the field associated with the motor stator 52 extends over at least that portion at which solidification is first initiated.

The dendrites which initially form normal to the periphery of the casting mold 12 are readily sheared off due to the metal flow resulting from the rotating magnetic field of the induction motor stator 52. The dendrites which are sheared off continue to be stirred to form degenerate dendrites until they are trapped by the solidifying interface. Degenerate dendrites can also form directly within the slurry because the rotating stirring action of the melt does not permit preferential growth of dendrites. To insure this, the stator 52 length should preferably extend over the full length of the solidification zone. In particular, the stirring force field associated with the stator 52 should preferably extend over the full length and cross section of the solidification zone with a sufficient magnitude to generate the desired shear rates.

To form a slurry casting 30 utilizing the apparatus 10 of FIG. 1, molten metal is poured into mold cavity 86 while motor stator 52 is energized by a suitable three-phase AC current of a desired magnitude and frequency. After the molten metal is poured into the mold cavity, it is stirred continuously by the rotating magnetic field produced by stator 52. Solidification begins from the mold wall 14. The highest shear rates are generated at the stationary mold wall 14 or at the advancing solidification front. By properly controlling the rate of solidification by any desired means as are known in the prior art, the desired thixotropic slurry S is formed in the mold cavity 86. As a solidifying shell is formed on the casting 30, the withdrawal mechanism 32 is operated to withdraw casting 30 at a desired casting rate.

The various laminated mold embodiments of the instant invention could also be used in vertical semisolid thixotropic slurry casting systems. U.S. patent application Ser. No. 258,232, filed Apr. 27, 1981 to Winter et al., which is hereby incorporated by reference, discloses such a suitable vertical casting system.

In the disclosed stirring process, two competing processes, shearing and solidification, are controlling. The shearing produced by the electromagnetic process and apparatus of this invention can be made equivalent to or greater than that obtainable by mechanical stirring.

It has been found that such governing parameters for the process as the magnetic induction field rotation frequency and the physical properties of the molten metal combine to determine the resulting motions. The contribution of the above properties of both the process and melt can be summarized by the formation of two dimensional groups, namely $\beta$ and N as follows:

$$\beta = \sqrt{j\omega\sigma\mu_o R^2} \tag{2}$$

$$N = \frac{\sigma R^2 \langle B_r \rangle_o^2}{\eta_o} \tag{3}$$

where $$j = \sqrt{-1}$$

$\omega$ = angular frequency
$\sigma$ = melt electrical conductivity
$\mu_o$ = melt magnetic permeability R=melt radius $\langle B_r \rangle_o$=radial magnetic induction at the mold wall $\eta_o$=melt viscosity.

The first group, $\beta$, is a measure of the field geometry effects, while the second group, N, appears as a coupling coefficient between the magnetomotive body forces and the associated velocity field. The computed velocity and shearing fields for a single value of $\beta$ as a function of the parameter N can be determined.

From these determinations it has been found that the shear rate is a maximum toward the outside of the mold. This maximum shear rate increases with increasing N. Furthermore, by using the mold of the instant invention, the magnetic induction absorption effect of the mold is reduced and the radial magnetic induction $B_{rms}$ at the periphery of the molten metal is increased. Consequently, the maximum shear rate increases.

It has also been recognized that the shearing is produced in the melt because the peripheral boundary or mold wall is rigid. Therefore, when a solidifying shell is present, shear stresses in the melt should be maximal at the liquid-solid interface. Further, because there are always shear stresses at the advancing interface, it is possible to make a full section ingot 30 with the appropriate degenerate dendritic slurry cast structure.

To test the effectiveness of the mold of the instant invention, molds were constructed in accordance with several embodiments of the instant invention. Each mold was placed coaxially inside the stator of a three phase motor, and the magnetic field was measured at the center of the stator. Similar measurements for an empty stator or no mold condition and for a stator with a standard solid aluminum tube type mold having a length of about six inches, a thickness of about $\frac{1}{4}''$, and substantially the same inner diameter as the laminated molds were done for comparison.

A completely laminated mold was formed from aluminum rings about 1/16" thick and having an inner radius of about $1\frac{7}{8}''$ and an outer radius of about $2\frac{1}{4}''$. Each ring was painted with an insulating varnish about 3 mils thick and stacked on top of previously painted rings. The rings were bonded together and a tubular cylindrical mold about six inches long was constructed.

An aluminum laminated mold was formed from an aluminum tube about six inches long having an inner radius of about $1\frac{7}{8}''$ and an outer radius of about $2\frac{1}{4}''$. A plurality of slits, each having a thickness about 0.032", were cut in the tube. The slits extended from the outer wall to within about 1/16" of the inner tube wall. The thickness of the tube sections between the slits being about 1/16".

A copper laminated mold was constructed in the same fashion as the aluminum laminated mold. The copper laminated mold was formed out of a copper alloy comprising 1% Cr, balance essentially consisting of copper.

Figure 8:
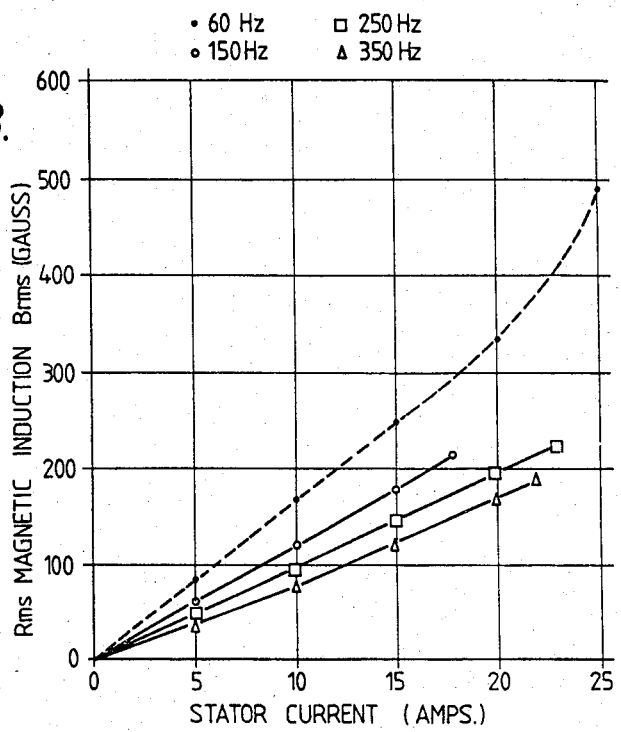
FIG. 8 is a graph showing the magnetic induction at the inner mold wall as a function of stator current and line frequency for a standard aluminum mold used in a casting system such as that described herein.
Figure 9:
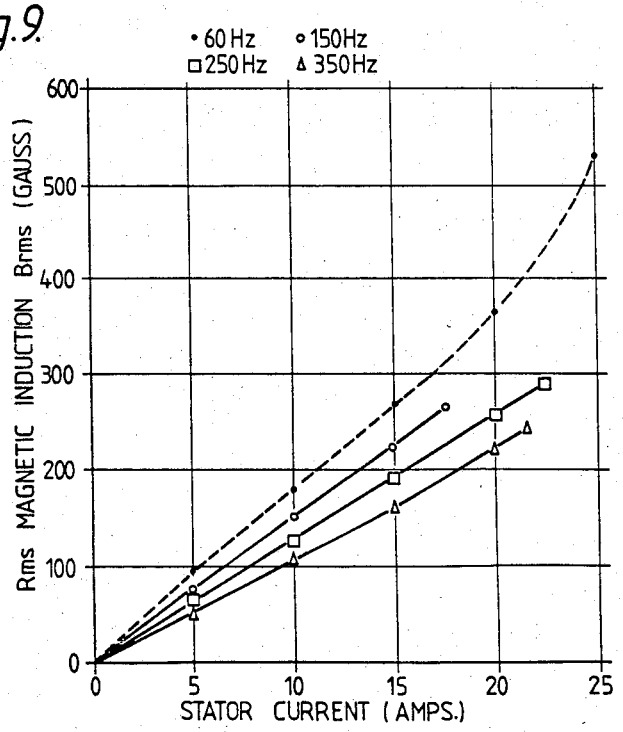
FIG. 9 is a graph showing the magnetic induction at the inner mold wall as a function of stator current and line frequency for a laminated aluminum mold used in a casting system such as that described herein.
Figure 10:
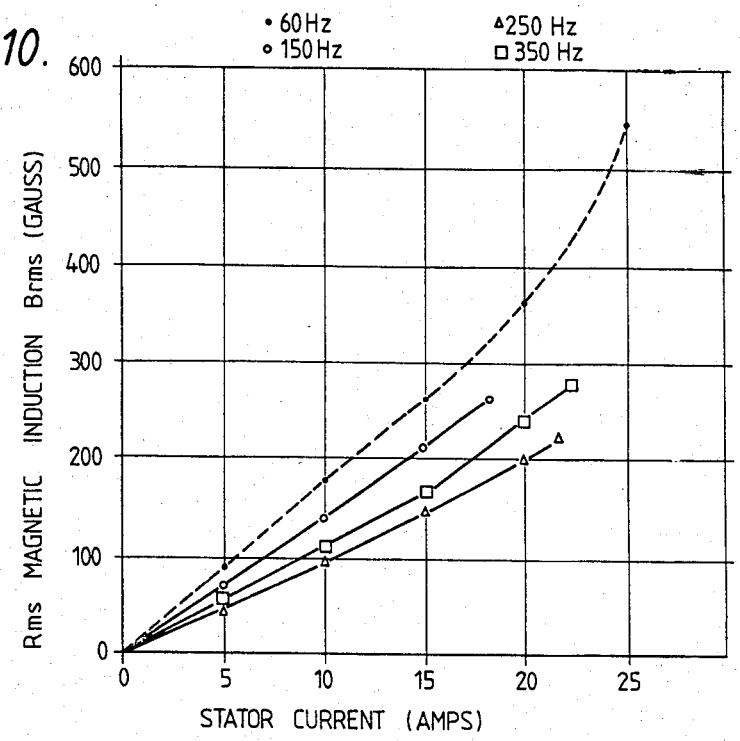
FIG. 10 is a graph showing the magnetic induction at the inner mold wall as a function of stator current and line frequency for a laminated copper mold used in a casting system such as that described herein.
Figure 11:
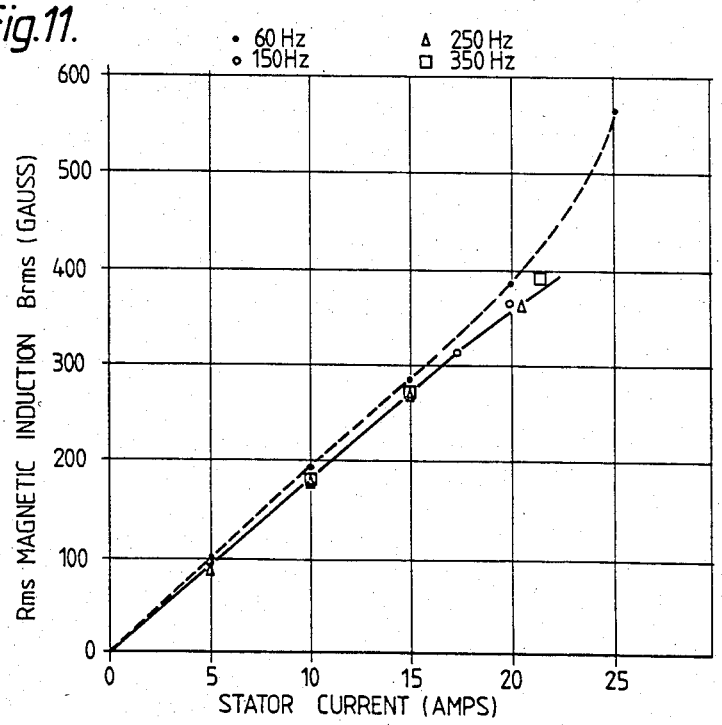
FIG. 11 is a graph showing the magnetic induction at the inner mold wall as a function of stator current and line frequency for a completely laminated aluminum mold used in a casting system such as that described herein.

The magnetic field at the inner mold wall or periphery of the molten metal for line frequencies of about 60, 150, 250 and 350 Hz and for stator current up to about 25 amps was measured for each mold type and for a no mold or empty stator condition. FIG. 8 shows curves representing the magnetic induction at the outside periphery of the melt or the inner mold wall vs. stator current for frequencies of 60, 150, 250 and 350 Hz for the standard aluminum mold. FIGS. 9–11 show curves representing the magnetic induction vs. stator current for the same frequencies for the laminated aluminum, laminated copper and completely laminated molds. The magnetic induction vs. stator current curves for the completely laminated mold of FIG. 11 are identical to the measurements for the empty stator condition.

Figure 12:
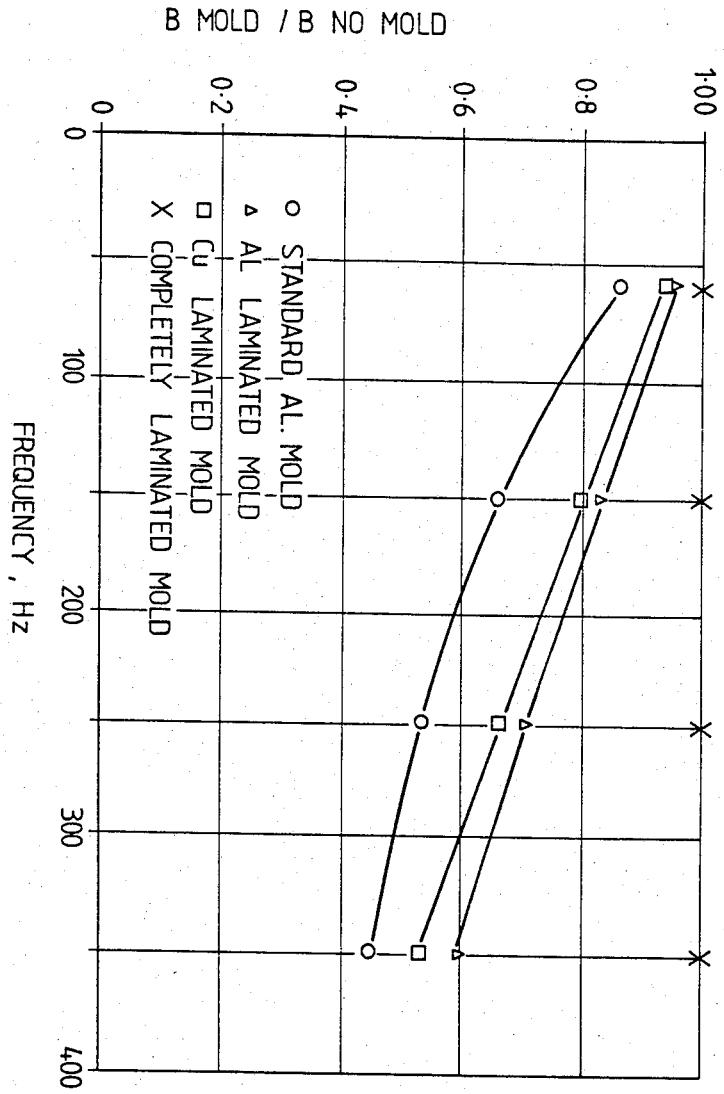
FIG. 12 shows a comparision of the magnetic induction vs. frequency curves for a standard aluminum mold, a laminated aluminum mold, a laminated copper mold, and a completely laminated aluminum mold.

FIG. 12 shows a comparison of the magnetic induction as a non-dimensional number $B_{mold}/B_{no\ mold}$ vs. frequency curves for the various mold types. It can be seen from this figure that the magnetic field measured for the various laminated mold embodiments is greater than the magnetic field measured for the standard aluminum mold for all measured frequencies.

Suitable shear rates for carrying out the process of this invention comprise from at least about 400 sec.$^{-1}$ to about 1500 sec.$^{-1}$ and preferably from at least about 500 sec.$^{-1}$ to about 1200 sec.$^{-1}$. For aluminum and its alloys, a shear rate of from about 700 sec.$^{-1}$ to about 1100 sec.$^{-1}$ has been found desirable.

The average cooling rates through the solidification temperature range of the molten metal in the mold should be from about 0.1° C. per minute to about 1000° C. per minute and preferably from about 10° C. per minute to about 500° C. per minute. For aluminum and its alloys, an average cooling rate of from about 40° C. per minute to about 500° C. per minute has been found to be suitable.

The parameter $|\beta^2|$($\beta$ defined by equation (2)) for carrying out the process of this invention should comprise from about 1 to about 10 and preferably from about 3 to about 7.

The parameter N (defined by equation (3)) for carrying out the process of this invention should comprise from about 1 to about 1000 and preferably from about 5 to about 200.

The line frequency f for casting aluminum having a radius from about 1 inch to about 10 inches should be from about 3 to about 3000 hertz and preferably from about 9 to about 2000 hertz.

The required magnetic field strength is a function of the line frequency and the melt radius and should comprise from about 50 to 1500 gauss and preferably from about 100 to about 600 gauss for casting aluminum.

The particular parameters employed can vary from metal system to metal system in order to achieve the desired shear rates for providing the thixotropic slurry.

Solidification zone as the term is used in this application refers to the zone of molten metal or slurry in the mold wherein solidification is taking place.

Magnetohydrodynamic as the term is used herein refers to the process of stirring molten metal or slurry using a moving or rotating magnetic field. The magnetic stirring force may be more appropriately referred to as a magnetomotive stirring force which is provided by the moving or rotating magnetic field of this invention.

The process and apparatus of this invention is applicable to the full range of materials as set forth in the prior casting art including, but not limited to, aluminum and its alloys, copper and its alloys, and steel and its alloys.

While the invention herein has been described in terms of a particular continuous or semi-continuous casting system, the laminated mold embodiments can be used in conjunction with other types of casting systems, such as static casting systems, which utilize electromagnetic stirring of some portion of the melt during solidification.

The patents, patent applications, and articles set forth in this specification are intended to be incorporated by reference herein.

It is apparent that there has been provided in accordance with this invention an improved mold for use in casting systems for making thixotropic metal or metal alloy slurries which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A mold for containing molten metal alloy in a casting system, said mold being adapted to have electrical currents induced therein in a first direction as a result of electromagnetically mixing said molten metal, said mold comprising:

a plurality of laminations formed from metal or metal alloy material;

a plurality of means for electrically insulating said laminations from each other, said insulating means being oriented so that its smaller dimension is substantially transverse to said first direction for minimizing the path lengths of at least some of said induced currents whereby magnetic induction losses caused by said mold are substantially reduced;

said mold being in the shape of a tube having inner and outer walls;

said insulating means comprising a plurality of slits in said tube extending from said outer wall to substantially near said inner wall; and said plurality of laminations comprising sections of said tube separated by said slits.

2. A process for fabricating a mold for use in molten metal or metal alloy casting systems, said mold being adapted to have electrical currents induced therein in a first direction as a result of electromagnetically mixing said molten metal, said process comprising:

forming a plurality of metal or metal alloy laminations;

electrically insulating said laminations from one another with a plurality of electrical insulating means, orienting said insulating material so that its smaller dimension is substantially transverse to said first direction for minimizing the path lengths of at least some of said induced currents whereby magnetic induction losses caused by said mold are substantially reduced;

said step of forming a plurality of laminations comprising providing a tubular container having inner and outer walls; and said step of electrically insulating comprising cutting a plurality of slits in said tubular container extending from said outer wall to substantially near said inner wall, whereby sections of said tubular container separated by said slits comprise said plurality of laminations.

3. A mold for containing molten metal or metal alloy in a casting system, said mold being adapted to have electrical currents induced therein in a first direction as the result of electrically mixing said molten metal, said mold comprising:

a plurality of stacked laminations formed from a metal or metal alloy material;

a plurality of means comprising electrical insulating material for electrically insulating said laminations from each other, said insulating material being oriented so that its smaller dimension is substantially transverse to said first direction for minimizing the path lengths of at least some of said induced currents, whereby magnetic induction losses caused by said mold are substantially reduced; and core sleeve means for thermally contacting said molten metal or metal alloy affixed to said stack of laminations.

4. The mold of claim 3 wherein: said core sleeve means comprises a tube of conductive material affixed to said stack of laminations.

5. The mold of claim 3 wherein: said core sleeve means comprises a sheet of conductive material plated to said stack of laminations.

6. A mold for containing molten metal or metal alloy in a casting system, said mold being adapted to have electrical currents induced therein in a first direction as the result of electrically mixing said molten metal, said mold comprising:

a plurality of stacked laminations formed from a metal or metal alloy material;

a plurality of means comprising electrical insulating material for electrically insulating said laminations from each other, said insulating material being oriented so that its smaller dimension is substantially transversed to said first direction for minimizing the path lengths of at least some of said induced currents, whereby magnetic induction losses caused by said mold are substantially reduced, wherein said electrical insulating means comprises an oxide layer on at least one surface of each of said laminations.

7. A process for fabricating a mold for use in molten metal or metal alloy casting systems, said mold being adapted to have electrical currents induced therein in a first direction as the result of electromagnetically mixing said molten metal, said process comprising forming a plurality of stacked metal or metal alloy laminations;

electrically insulating said laminations from one another with a plurality of electrical insulating means comprising electrical insulating material, and orienting said insulating material so that its smaller dimension is substantially transverse to said first direction for minimizing the path lengths of at least some of said induced currents whereby magnetic induction losses caused by said mold are substantially reduced; and affixing to said stack of laminations core sleeve means for thermally contacting said molten metal or metal alloy.

8. The process of claim 7 wherein:

said affixing step comprises affixing a tube of conductive material to said stack of laminations.

9. The process of claim 7 wherein:

said affixing step comprising plating a sheet of conductive material to said stack of laminations.

10. A process for fabricating a mold for use in molten metal or metal alloy casting systems, said mold being adapted to have electrical currents induced therein in a first direction as the result of electromagnetically mixing said molten metal, said process comprising forming a plurality of stacked metal or metal alloy laminations;

electrically insulating said laminations from one another with a plurality of electrical insulating means comprising electrical insulating material, and orienting said insulating material so that its smaller dimension is substantially transversed to said first direction for minimizing the path lengths of at least some of said induced currents whereby magnetic induction losses caused by said mold are substantially reduced, wherein said step of electrically insulating comprises coating at least one surface of each of said laminations with an oxide layer.

* * * * *